United States Patent [19]

Kuntz

[11] 4,059,248

[45] Nov. 22, 1977

[54] SHELF SUPPORT BRACKET FOR MOUNTING ON RAILINGS AND THE LIKE

[76] Inventor: Gregg R. Kuntz, 1005 E. La Veta, Orange, Calif. 92666

[21] Appl. No.: 710,258

[22] Filed: July 30, 1976

[51] Int. Cl.[2] ..... E04G 3/00

[52] U.S. Cl. ..... 248/214; 108/149; 248/236; 248/225.3

[58] Field of Search ..... 248/236, 238, 226 A, 248/235, 250, 214; 108/149, 151

[56] References Cited

U.S. PATENT DOCUMENTS

| | | | |
|---|---|---|---|
| 390,302 | 10/1888 | Koehler | 248/214 |
| 488,608 | 12/1892 | Hotchkiss | 248/214 |
| 945,280 | 1/1910 | Lindberg | 248/250 X |
| 957,324 | 5/1910 | Gall | 108/149 |
| 2,189,607 | 2/1940 | Krischke | 108/149 X |
| 2,557,147 | 6/1951 | Schatzman | 248/226 A X |
| 2,661,098 | 12/1953 | Wannop | 248/301 X |
| 2,849,728 | 9/1958 | Gyllenberg | 248/214 X |

*Primary Examiner*—Roy D. Frazier
*Assistant Examiner*—Peter A. Aschenbrenner
*Attorney, Agent, or Firm*—Gary Appel

[57] ABSTRACT

A shelf bracket, particularly adapted for mounting on railings and the like, comprises a mounting bracket formed in a generally inverted U-shape with first and second legs depending from ends of a transverse segment. An elongate rigid shelf supporting member is fixed to lower regions of the first leg, below the lower end of the shorter second leg, to project orthogonally outwardly away from the second leg. A thumbscrew is installed in the first leg, below the shelf supporting member for engaging a railing support and enabling leveling of a shelf supported by two or more brackets below the level of the railing. A second thumbscrew is provided in the second leg, relatively close to the transverse segment, for adapting the bracket to railings more narrow than the length of the transverse segment and for clamping the bracket to the railing. Locking nuts are provided for each thumbscrew to maintain the adjustments. An elastomeric "O" ring is installed over the projecting end of the shelf supporting member to prevent a shelf installed on the member from slipping off the end thereof.

5 Claims, 6 Drawing Figures

SHELF SUPPORT BRACKET FOR MOUNTING ON RAILINGS AND THE LIKE

BACKGROUND OF THE INVENTION

1. Field of the Invention

The present invention relates to the field of shelf support brackets, and more particularly to such brackets adapted for mounting onto a railing or the like.

2. Discussion of the Prior Art

Potted plants and flowers are always popular, particularly with apartment or townhouse dwellers having no yards for plants. However, even individuals having yards increasingly use potted plants for decorative purposes.

Numerous types of hangers are available for hanging potted plants from overhead beams, rafters and so forth. In addition, shelves mounted to window sills or walls by various types of detachable shelf brackets are available for supporting potted plants. Examples of such shelves and brackets are those disclosed by both Bartlett and Rogers (U.S. Pat. Nos. 1,224,127 and 1,914,617, respectively). Generally, the shelf brackets are adjustable to the extent that the shelf may be leveled when the brackets are mounted on different types of supporting structures.

A number of disadvantages are, however, associated with these types of support brackets, which are designed principally for being detachably mounted on window sills or on horizontal wall boards. These brackets are, for example, not adapted for being mounted on, or attached to, types of railings commonly found on balconies and around porches or patios where potted plants are often desired. For such railing use, the shelf brackets must be not only adjustable to enable leveling of a shelf installed on the brackets according to different sizes and types of railing supports, but also provide means for securing the brackets to different sizes of railings so that the brackets are not easily dislodged.

Furthermore, brackets of the types disclosed by Bartlett and Rogers receive the shelves at the top of the brackets, to be level with, for example, a window sill to which the brackets are mounted. As a result, potted plants or other articles placed on the shelves can easily be knocked off the shelves. This is generally unsatisfactory for railing mounted shelves, particularly on balconies from which the plants or articles might fall onto individuals or property below.

There is, therefore, a need for improved types of shelf brackets for mounting on railings and the like.

SUMMARY OF THE INVENTION

A shelf support bracket for mounting onto railings or the like comprises a railing attaching member formed in a general inverted U-shape for installing downwardly over a railing, and including first and second rigid legs depending from a rigid transverse segment. The attaching member includes means adapted both for accommodating the member to railings narrower than the length of the transverse segment and for clamping the member to the railing. An elongate rigid shelf supporting member fixed to the first leg projects perpendicularly outwardly therefrom and away from the second leg. Adjusting means mounted on the first leg enables leveling of the shelf supporting member, the adjusting means including a normally movable element having an inner end portion adapted for engaging a member or surface supporting the railing upon which the attaching member is mounted.

More specifically, the first leg is substantially longer than the second leg and the shelf supporting member is fixed to the first leg below the lower end of the second leg.

The adjusting means associated with the first leg and the clamping and adjusting means include first and second thumb screws, respectively, orthogonally threaded through the first and second legs respectively, the first thumbscrew being installed below the shelf supporting member. Locking nuts are installed on the thumbscrews for maintaining the thumbscrews in an adjusted or clamping position.

An inner end of the adjusting means movable element may include means fitting around portions of a railing support for insuring engagement of the movable element therewith. Means may also be provided on the shelf supporting member for preventing a shelf installed on the member from slipping off the end thereof.

BRIEF DESCRIPTION OF THE DRAWINGS

A better understanding of the present invention may be had from a consideration of the following detailed description, taken in conjunction with the accompanying drawing in which.

DESCRIPTION OF THE PREFERRED EMBODIMENT

Figure 1:
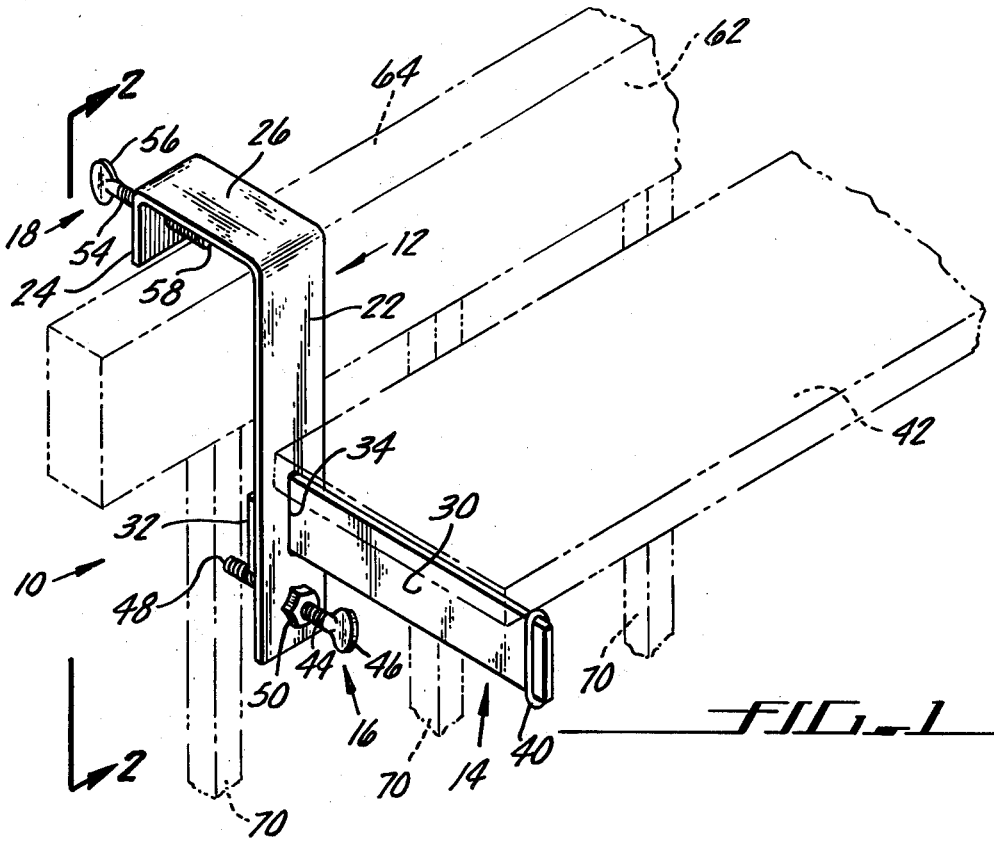
FIG. 1 is a perspective view of the shelf support bracket, showing the bracket mounted on a railing.
Figure 2:
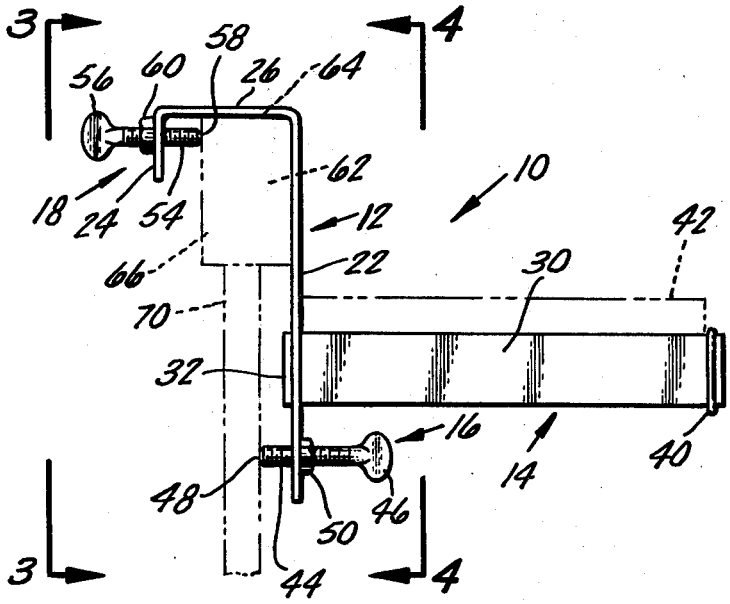
FIG. 2 is a side elevational view along line 2—2 of FIG. 1, showing features of the support bracket.

As best seen in FIGS. 1 and 2, a shelf support bracket 10, particularly adapted for mounting on railings and the like, comprises generally a mounting bracket or member 12, a shelf support member or arm 14, a shelf leveling means 16 and a railing adjusting and clamping means 18.

Figure 3:
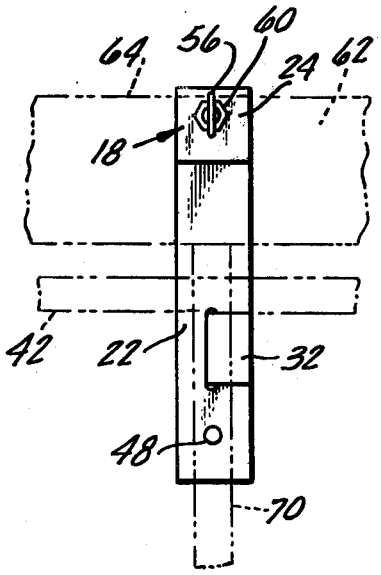
FIG. 3 is a rear elevational view along line 3—3 of FIG. 2, showing the railing adjusting and clamping means.

The mounting bracket 12, formed in an inverted U-shape, has a long, rigid first or front leg 22 and a shorter, rigid second or rear leg 24, the legs 22 and 24 depending at right angles from opposite ends of a transverse portion 26. Fixed along a central, vertical axis of the first leg 22, in a lower region preferably below the lower end of the second leg 24, is the shelf support member 14. As illustrated in FIGS. 1–3, the member 14 is constructed in a general L-shape, having an elongate shelf supporting portion 30 and a much shorter portion 32 formed at a right angle thereto.

Assembly of the member 14 to the first leg 22 is by inserting the shelf supporting portion 30 outwardly through a slot 34 formed in the leg and then attaching, as by welding, the shorter portion 32 to the back side of the leg. Alternatively, the shelf supporting portion may be formed integrally with the bracket 12, for example, by being portion of a stamping and being initially in a plane with the first leg. Then the shelf supporting portion is bent to project outwardly orthogonally from the first leg, as is shown in FIGS. 1 and 2 for the member 14.

In any case, the shelf supporting portion 30 is preferably constructed to be rectangular in cross section and is connected to the first leg 22 so that the long cross sectional axis of the shelf supporting portion is parallel to the long axis of the first leg to prevent bending of the member 14 in use.

A shelf retaining stop 40 is installed at the outer end of the shelf supporting portion 30 of the member 14 to prevent a shelf 42 (shown in phantom lines) from sliding outwardly off the end of the member. As shown, the stop 40 comprises, both for low cost considerations and to enable easy adjustment for different shelf widths, an elastomeric ring, such as a conventional "O" ring, which is slipped over the end of the shelf supporting portion 30. An alternate type of stop may, for example, be provided by forming the shelf supporting portions 30 to have an upwardly projecting tab or ear (not shown) at the outer end.

Figure 4:
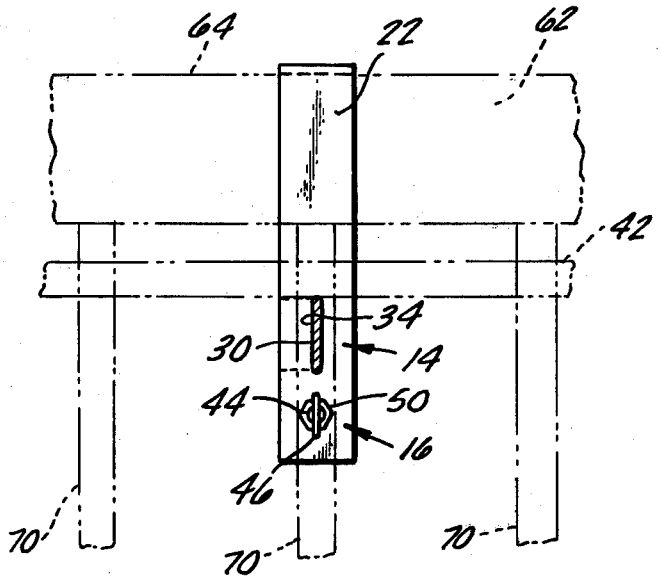
FIG. 4 is a front elevational view along line 4—4 of FIG. 2, showing the shelf leveling means.

Two types of shelf support adjustments are provided: the shelf leveling means 16 and the railing adjusting and clamping means 18. These means 16 and 18 enable the shelf support bracket 10 to be adapted to a wide variety of mounting structure sizes and configurations. The shelf leveling means 16 preferably comprises a manually adjustable thumb screw 44 installed through a threaded aperture (not shown) in the first leg 22, below the member 14 and in vertical alignment therewith, with a head end 46 projecting outwardly in the direction of such member (FIGS. 1, 2 and 4) and a support contacting end 48 projecting inwardly (FIGS. 1–3). A locking nut 50, installed over the thumbscrew 44 between the head end 46 and the first leg 22 is tightened against the leg after the thumbscrew is adjusted in a desired manner to lock the adjustment against movement.

Similarly, the railing adjusting and clamping means 18 includes a thumbscrew 54 having outwardly projecting head end 56 and a railing engaging inner end 58, the thumbscrew being installed orthogonally through the second leg 24 in a generally central region, and thus relatively close to the transverse segment 26. A locking nut 60 is installed on the thumbscrew 54, between the head end 56 and the second leg 24 to lock adjustment of such thumbscrew.

For installation, as depicted in FIGS. 1 and 2, with the thumbscrew 54 loose, the bracket 10 is installed downwardly over a railing 62 (shown in phantom lines) or another similar mounting structure, until the under side of the transverse portion 26 rests on a top surface 64 of the railing, etc. The thumbscrew 54 is then tightened to bring the inner end 58 thereof into clamping engagement with a rear surface 66 of the railing 62 (FIG. 2). Then the locking nut 60 is tightened against the second leg 24 to lock the bracket 10 tightly onto the railing 62.

Before, or as, the thumbscrew 54 is tightened, the bracket 10 is laterally positioned on the railing 62 so that the inner end 48 of the shelf leveling thunmbscrew 44 is in alignment with a railing support member 70 (shown in phantom lines, FIGS. 1–4). When the thumbscrew 44 is so aligned, it is adjusted until the shelf support member 14 is level (horizontal); the locking nut 50 is then tightened against the first leg 22 to lock the thumbscrew 44 in position.

Figure 5:
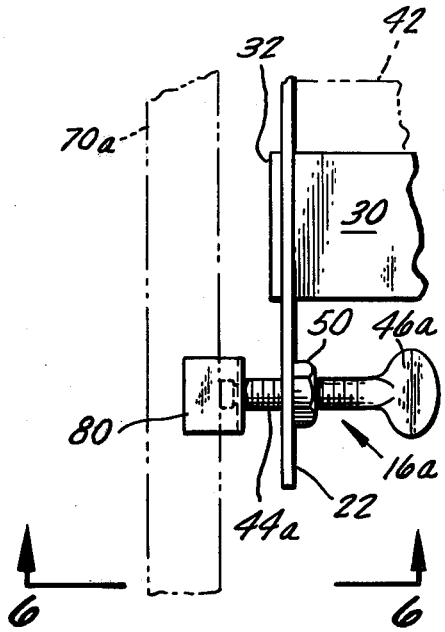
FIG. 5 is a partial side elevational view, showing a variation of the shelf leveling means.
Figure 6:
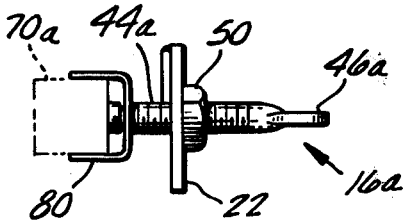
FIG. 6 is a bottom view along line 6—6 of FIG. 5, showing features of the shelf leveling means variation.

As seen in FIGS. 5 and 6, a variation thumbscrew 44*a*, similar to the thumbscrew 44 described above, and part of an adjusting means 16*a*, may be constructed having an inner end fitting 80 contoured to fit partially around a conventionally shaped wrought iron (or other type) railing support 70*a*. Preferably the fitting 80 is pivotally mounted to the thumbscrew 44*a* so that the thumbscrew can be adjusted with the fitting in engagement with the railing support 70*a*. By the fitting 80, the thumbscrew 44*a* is prevented from slipping sideways out of engagement with the support 70*a*.

After two or more of the brackets 10 are installed on the railing 62 in the above described manner, the shelf 42 is placed onto the shelf support member 14. Potted plants, etc. may then be placed on the shelf. Because the support member 14 is positioned near the lower end of the first leg 22, the shelf 42 is well below the transverse segment 26, and hence below the railing 62 upon which the bracket 10 is installed. The railing 62 thus also serves to prevent plants or articles from being accidentally pushed rearwardly off the shelf 42.

The first bracket leg 22 may be about 5¼ inches long, the second leg 24 may be about 1 inch long, the segment 26 may be about 2 inches long and the support member 30 may be 8 inches long. All such parts may be about 1 inch wide and made of about ⅛ inch thick iron or aluminum and 1 inch wide. The bracket 10 is thus strong and rigid but is comparatively simple and inexpensive to construct. It is also adaptable to many types of supporting structures and clamps securely thereto to provide a sturdy, but easily removable, shelf support.

It is to be appreciated that the bracket 10 may also be made in a more symmetrical manner with both the first and second legs 22 and 24 of about equal lengths and with shelf supporting members 14 fixed to both legs. With such a configuration, a pair of shelves may be installed, one on each side of the railing to which the bracket is mounted. Or, more than one shelf supporting member may be fixed to the first leg 22 and/or to the second leg 24 so that two or more shelves may be supported, in vertical spaced relationship, on the same leg.

Although there has been described above a specific arrangement of a shelf bracket particularly adapted for use on railings and the like in accordance with the invention for the purpose of illustrating the manner in which the invention may be used to advantage, it will be appreciated than the invention is not limited thereto. Accordingly, any and all modifications, variations or equivalent arrangements which may occur to those skilled in the art should be considered to be within the scope of the invention as defined in the appended claims.

What is claimed is:

1. A shelf support bracket for mounting onto railings or the like, which comprises:

a. a one piece railing attaching member formed in a general inverted U-shape adapted for fitting downwardly over a railing or the like and including first and second rigid legs of unequal lengths from a rigid transverse segment, said first leg being substantially shorter than said second leg, said second leg having mounted thereto rail clamping means adapted both for accommodating the member to railings narrower than the length of the transverse segment and for clamping the member to the railing.

b. an elongate rigid shelf supporting member fixed to said first leg below the lower end of the second leg and projecting generally perpendicularly therto and away from the second leg, c. adjusting means mounted on the first leg for enabling leveling of the shelf supporting member, said adjusting means including a manually movable element having an inner end portion adapted to engage a member or surface supporting the railing upon which the bracket is mounted, and d. shelf stop including an elastomeric ring slidingly installed over said shelf supporting member and positioned to engage an outer edge of a shelf supported by the bracket, positioning of the ring on the shelf supporting member corresponding to the width of the shelf.

2. The bracket according to claim 1, wherein the rail clamping means includes a threaded element installed orthogonally through the second leg, said threaded element having an inner, railing engaging end and an outer end portion adapted for manually turning to advance or retract the element as necessary to adapt the bracket to a particular railing thickness, and including a locking nut installed over the threaded element for locking the element to the second leg in an adjusted position.

3. The bracket according to claim 1, wherein the adjusting means movable element is externally threaded and is received in a threaded aperture formed through the first leg, said movable element having an outer end portion adapted for manually turning the element to advance or retract the element as required to level the shelf supporting arm, and including a locking nut for locking the movable element to first leg in an adjusted position, an inner end portion of the movable element including means adapted for fitting around portions of a member supporting the railing upon which the bracket is mounted to thereby assure engagement therewith.

4. The bracket according to claim 1, wherein the shelf supporting member is rectangular in cross section, the member being fixed to the first leg with a major axis parallel to a longitudinal axis through the first leg and wherein the first leg is formed substantially longer than the second leg and the rail supporting member is fixed to a lower region of the first arm below the lower end of the second leg.

5. The bracket according to claim 1, wherein the adjusting means movable element and rail clamping means comprise first and second elongate thumbscrews, respectively, said first and second thumbscrews being threaded orthogonally through apertures formed in the first and second legs, respectively, and including locking nuts installed on the thumbscrews for locking the thumbscrews in an adjusted and clamping position.

* * * * *